United States Patent [19]

Matsuoka

[11] Patent Number: 4,962,887

[45] Date of Patent: Oct. 16, 1990

[54] ACCUMULATOR FUEL INJECTION SYSTEM

[75] Inventor: Hiroshi Matsuoka, Yamato, Japan

[73] Assignee: Isuzu Motors Limited, Tokyo, Japan

[21] Appl. No.: 418,355

[22] Filed: Oct. 6, 1989

[30] Foreign Application Priority Data

Oct. 21, 1988 [JP] Japan ..... 63-263994

[51] Int. Cl.[5] ..... F02M 47/02; F02M 57/02

[52] U.S. Cl. ..... 239/95; 239/124; 239/533.8

[58] Field of Search ..... 239/90, 91, 93, 94, 239/95, 124, 553.8

[56] References Cited

U.S. PATENT DOCUMENTS 4,326,672 4/1982 Goloff ..... 239/91

FOREIGN PATENT DOCUMENTS 195736 9/1986 European Pat. Off. .
58-66164 5/1983 Japan .
133172 9/1985 Japan .
6432063 2/1989 Japan .

*Primary Examiner*—Andres Kashnikow
*Assistant Examiner*—Karen B. Merritt
*Attorney, Agent, or Firm*—Browdy and Neimark

[57] ABSTRACT

In the accumulator fuel injection system according to the present invention, a leak passage is formed in an accumulator in which a fuel supply pressure from a fuel injection pump is temporarily stored, and a control valve adapted to be opened and closed by the energization of a solenoid so as to pen and close this leak passage is provided. In order to secure a predetermined fuel injection quantity, the pressure in the accumulator is reduced suddenly by an operation of the control valve to a level not higher than a needle valve closing pressure to shorten the fuel injection time and increase the pressure in the accumulator to a high level, whereby a fuel injection rate is increased. A pressure chamber having a relief valve therein is further provided in the portion of the leak passage which is on the downstream side of the control valve. Therefore, even when an ignition delay is shortened in a high-temperature condition of a heat insulating engine, the quantity of the fuel to be injected into a combustion chamber is maintained constantly at a predetermined level, and the performance of the engine is improved. Moreover, the pressure chamber prevents a leak pressure from decreasing to a level not higher than a predetermined level, so that a wasteful operation can be minimized during the increasing of the pressure in the accumulator while a subsequent fuel injecting step is carried out.

10 Claims, 5 Drawing Sheets

ACCUMULATOR FUEL INJECTION SYSTEM

BACKGROUND OF THE INVENTION

1. Field of the Invention

This invention relates to an accumulator fuel injection system for diesel engines.

2. Description of the Prior Art

The conventional accumulator fuel injection systems for diesel engines include a fuel injection system disclosed in FIG. 10. This accumulator fuel injection system 60 consists of a fuel injection nozzle for supplying a fuel to be injected to an accumulator 5 so as to inject the fuel via an injection port 11, which is formed in a fuel injection nozzle body 15, into a combustion chamber in an engine, and a needle valve 3 for opening and closing the injection port 11 is provided in the accumulator 5 formed in the fuel injection nozzle body 15, a check valve 2 being provided slidably on this needle valve 3. This check valve 2 is formed so that it can utilize the needle valve 3 as a shaft thereof and move slidingly in the vertical direction along the outer circumferential surface thereof. The check valve 2 is urged by a spring 4 against a check valve seat 6 provided on the upper surface of the accumulator 5, whereby the communication between a fuel passage 13 and accumulator 5 is cut off, a clearance 7 being formed between the outer circumferential surface of the check valve 2 and the inner circumferential surface of the accumulator 5. In such a fuel injection system 60, the fuel sent under pressure by a fuel injection pump 8, which is driven by the engine, overcomes the spring 4 owing to the fuel supply pressure and enters the accumulator 5 through the check valve 2, injection pipe 9, fuel passage 13, through bore 14 in the check valve seat 6, and clearance 7 on the outer side of the outer circumferential surface of the check valve 2. When a period of the pressure-sending of the fuel by the fuel injection pump 8 has then finished, the pressure in the injection pipe 9, fuel passage 13 and through bore 14 in the check valve seat 6 suddenly decreases. Consequently, the force working on the upper surfaces of the needle valve 3 and check valve 2, i.e. a portion designated by a reference letter A is lost. As a result, the fuel pressure confined in the accumulator 5 overcomes the force of the spring 4 to slidingly move the check valve 2 and needle valve 3 in the upward direction. Accordingly, the injection port 11 is opened, and the fuel starts being ejected therefrom. When the injection of the fuel is started, the pressure in the accumulator 5 suddenly decreases, and the injection of the fuel into the combustion chamber is carried out until the force of the spring 4 has overcome the fuel pressure in the accumulator 5. A reference numeral 12 in the drawing denotes a slide surface of the needle valve 3.

Regarding this accumulator fuel injection system 60, a crank angle $\theta$, an injection rate R and a pressure P in the accumulator 5 have the relation shown in the graph of FIG. 11. The crank angle $\theta$ of the engine is plotted on the lateral axis, and the injection rate R and pressure P in the accumulator 5 on the longitudinal axis. In this case, the injection quantity is expressed by the equation:

$$Q = V/K \cdot (Pi - Ps)$$

wherein V is the capacity of the accumulator; K the elastic modulus of the fuel; Pi the pressure in the accumulator; and Ps the pressure, which is determined by the force of the spring 4, for closing the needle valve 3.

A curve L represents an injection quantity in a case of a low load, and a curve H an injection quantity in a case of a high load. A point B represents a point in time at which the pressure-sending of the fuel from the fuel injection pump 8 is started, and a point E a point in time at which the period of pressure-sending of the fuel from the fuel injection pump 8 is finished. A point D represents a point in time at which the injection of the fuel from the injection port 11 of the fuel injection nozzle in a case of a low load is started, and a point C or E a point in time at which the injection of the fuel from the injection port 11 in a case of a high load is started. A region from a point D to a point $\theta_4$ represents a fuel injection period in a case of a low load, and a region from a point C to a point $\theta_5$ a fuel injection period in a case of a high load. Accordingly, the fuel injection quantity Q in a case of a low load is shown by a curve l, and that in a case of a high load by a curve m.

The conventional fuel injection systems used for diesel engines further include a fuel injection system disclosed in Japanese Utility Model Laid-open No. 66164/1983. In this fuel injection system, a shaft having a needle valve for opening and closing an injection port is provided in an accumulator in an injection nozzle body which is provided with the injection port, and a check valve on this shaft slidably. The check valve is urged by a spring toward the upper surface of the accumulator to cut off the communication between a fuel injection passage and accumulator, and a clearance is provided between the outer circumferential surface of the check valve and the inner circumferential surface of the accumulator. A push rod is urged by a spring against the upper end surface of the shaft in the injection nozzle body to retain the push rod in a position in a clearance formed between the push rod and shaft, and the fuel injection passage is opened at the portion of the upper surface of the accumulator which is not in alignment with the upper surface of the shaft.

There is also a fuel injection nozzle disclosed in Japanese Utility Model Laid-open No. 133172/1985. In this fuel injection nozzle, a fuel from a pump is supplied from a fuel supply passage to a high-pressure chamber via a check valve and from the high-pressure chamber to a needle valve-holding accumulator via a check valve. The fuel supplied to the high-pressure chamber is pressurized by a smaller-diameter high-pressure plunger, which is formed integrally with a larger-diameter low-pressure piston, by applying a pressure to this piston, to accumulate the pressure in the accumulator, and the pressure applied to the low-pressure piston is then reduced to lift the needle valve, by which the injection port at the free end of the nozzle has been closed, and eject the fuel from the same injection port. This fuel injection nozzle is also provided with a pressure regulating means for lifting the needle valve in a stepped manner when the fuel is ejected.

A heat insulating engine in which a cylinder head, a cylinder liner, a piston head and a valve are formed out of a ceramic material has already been disclosed. In this heat insulating engine, the temperature at the end of a compression stroke thereof becomes extremely high in comparison with that in a regular engine, so that the time between the starting of the ejection of the fuel and the occurrence of ignition thereof, i.e. the ignition delay decreases to a great extent. This means that the quantity of the fuel injected into the combustion chamber until the engine ignition time decreases. Therefore, the premixed combustion immediately after the engine ignition decreases, and the performance of the engine is affected adversely and greatly. In order to eliminate these inconveniences, the fuel injection time is reduced to as great an extent as possible, and a required quantity of fuel is injected within this injection time, in a heat insulating engine. Accordingly, it is effective to use a unit injector capable of injecting a fuel under a high pressure Especially, in a heat insulating engine, an accumulator fuel injection system having a high initial injection rate at the injection starting time is optimumly used. If the accumulator fuel injection system 60 is applied to a heat insulating engine, in which an injection quantity Q is expressed by the equation, $$Q=V/K\cdot(Pi-Ps)$$

increasing Pi is one good method of increasing the injection rate R. However, if Pi is increased, it results in an increase in the maximum injection quantity assuming that Ps is constant. In order to prevent this from occurring, it is necessary to reduce the capacity V of the accumulator 5. Reducing the capacity V of the accumulator 5 is very difficult in view of the construction of the fuel injection nozzle.

In order to solve these problems, the inventor of the present invention developed an accumulator fuel injection system provided with a leak means in an accumulator, and filed previously Japanese Patent Application No. 187689/1987 (refer to Japanese Patent Laid-open No. 32063/1989) for the invention. The reliability of the operation accuracy of a control valve constituting the leak means in the accumulator fuel injection system is low in view of the construction thereof, and this leak means causes the pressure in the accumulator to decrease excessively when a leak occurs.

In the above-described fuel injection nozzle disclosed in Japanese Utility Model Laid-open No. 133172, a pressure regulating means for lifting the needle valve in a stepped manner is provided for the purpose of increasing the fuel pressure, atomizing the fuel, increasing the fuel particle scattering distance and reducing the injection time. However, since a high pressure is generated by the fuel injection pump so as to increase the pressure, a sufficiently high injection pressure cannot be obtained by this method. The effect of this method is limited due to the Hertz's stress in a cam member, and, moreover, the method causes the construction of the injection nozzle to become complicated. The fuel injection system disclosed in Japanese Utility Model Laid-open No. 66164/1983 referred to above is adapted to suppress an increase, which is ascribed to the combustion of a gaseous mixture, of the pressure in the combustion chamber when an engine load is high, by having the resultant force of springs act on, by increasing the injection pressure with a predetermined time lag, delaying an injection peak, and preventing the fuel from being injected at a suddenly increased pressure. However, this fuel injection system is not capable of solving the above-mentioned problems.

SUMMARY OF THE INVENTION

An object of the present invention is to solve the problems mentioned above; attain the obtainment of the injection characteristics suitable for a heat insulating engine, and the improvement of the performance of such an engine, by increasing the pressure in an accumulator and thereby improving an injection rate or suitably controlling a period in which the pressure in the accumulator starts increasing, for the purpose of constantly securing a predetermined fuel injection quantity without causing the quantity of the fuel, which is injected into a combustion chamber in the engine, to decrease before the time of ignition of the engine, and without causing the level of the premixed combustion immediately after the ignition of the engine to decrease, even when the temperature at the end of a compression stroke of the engine increases to a high level to cause the time between the starting of the fuel injection and ignition of the engine, i.e. an ignition delay to decrease greatly, and, moreover, by reducing the needle valve closing pressure in the accumulator earlier and more speedily than when a regular closing responsiveness of the needle valve is followed; and, especially, provide an accumulator fuel injection system having a leak mechanism for reducing the pressure in an accumulator, which consists of a plunger type control valve capable of preventing a leak pressure from decreasing to a level not higher than a predetermined level, and of controlling a leak period and leak pressure with a very high accuracy.

Another object of the present invention is to provide an accumulator fuel injection system having a leak passage formed in an accumulator in which a fuel supply pressure from a fuel injection pump is temporarily accumulated, a plunger adapted to be operated by a solenoid and provided in the leak passage, and a relief valve-holding constant pressure chamber through which the fuel leaking to the leak passage is made overflow, and capable of reducing the pressure in the accumulator to a level not higher than that of a needle valve closing pressure after the termination of a period of the pressure-sending of the fuel to the accumulator and when a predetermined period of time has elapsed after the subsequent starting of injection of the fuel from an injection port to a combustion chamber if the pressure in the relief valve is set not higher than a needle valve opening pressure and not lower than the atmospheric pressure, this enabling the prevention of a decrease of the pressure in the accumulator to an unnecessarily low level, whereby, even when the temperature at the end of a compression stroke of the engine becomes very high to cause the time between the starting of injection of the fuel and the ignition of the engine to decrease, it is possible to increase the initial injection rate to a high level by carrying out the injection of the fuel at a high pressure, finish in a short period of time the injection of a required quantity of fuel into the combustion chamber in the engine, and, moreover, minimize the time otherwise wastefully used for an accumulator pressure increasing operation in a subsequent fuel injecting step.

Still another object of the present invention is to provide an accumulator fuel injection system in which the operations of opening and closing the leak passage by means of the control valve are controlled by varying the angle of rotation of the plunger which is rotated when the solenoid is energized, or by varying the moving distance of the plunger which is moved forward and backward when the solenoid is energized, to enable the fuel supply pressure in the accumulator to be controlled accurately, and the leak of the pressure to be controlled speedily with an excellent responsiveness.

A further object of the present invention is to provide an accumulator fuel injection system for a heat insulating engine, which is capable of increasing the initial injection rate to a high level even when the temperature at the end of a compression stroke of the engine becomes high to cause the time between the starting of the injection of the fuel and the ignition of the engine to be reduced greatly; injecting a predetermined quantity of fuel into the combustion chamber in a short period of time owing to the function provided of leaking the accumulator pressure; regulating the starting point of the accumulator pressure leaking operation simply and variously in accordance with the engine load; using a fuel injection pump not requiring, for example, a maximum number of revolutions controlling governing means and a fuel flow rate control system owing to the fuel pressure leaking operation; reducing the pressure for closing the needle valve in the accumulator more speedily than in a regular engine so as not reduce the premixed combustion immediately after the ignition of the engine eve when the temperature at the end of a compression stroke of the heat insulating engine, which consists of a ceramic material, becomes extremely high as compared with that in a regular engine, to cause the time between the starting of the injection of the fuel and the ignition of the engine, i.e. an ignition delay to decrease greatly; constantly securing a predetermined fuel injection quantity by increasing the accumulator pressure in accordance with every possible reduction of the fuel injection period so as to increase the injection rate, so that the injection of the fuel into the combustion chamber in the engine can be carried out as the flow rate of the fuel being injected is regulated to a desired level constantly and simply in accordance with the engine load without causing a decrease in the absolute quantity of the fuel supplied in a period between the starting of the injection of the fuel and the ignition of the engine; and thereby improving the performance of the engine.

DESCRIPTION OF THE PREFERRED EMBODIMENTS

The embodiments of the accumulator fuel injection system according to the present invention will now be described with reference to the drawings.

Figure 1:
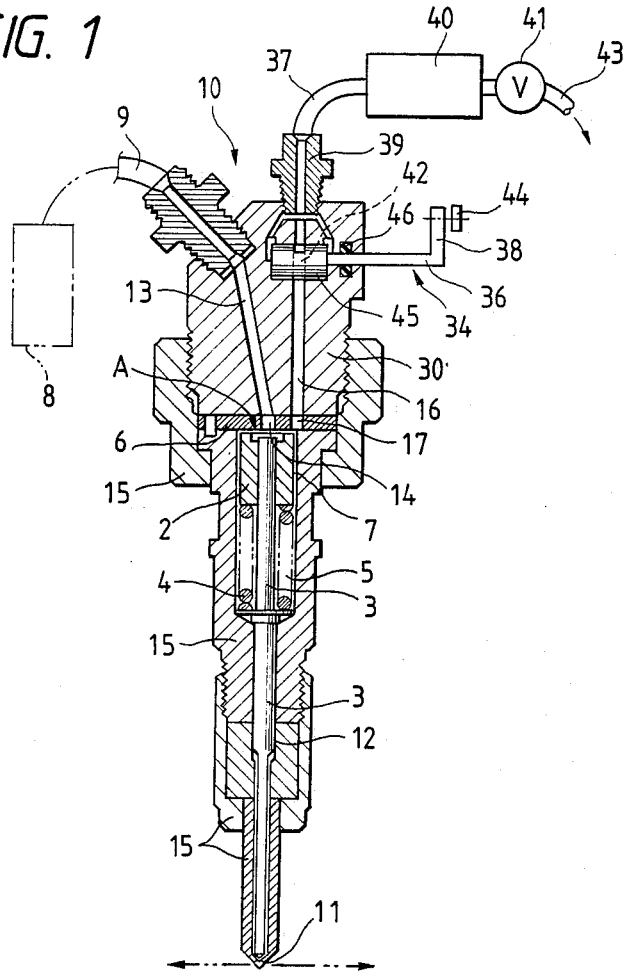
FIG. 1 is a sectional view of an embodiment of the accumulator fuel injection system according to the present invention.
Figure 2:
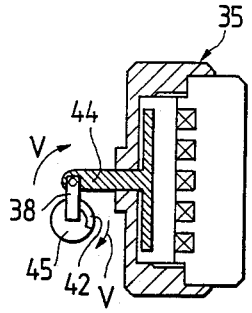
FIG. 2 illustrates the operation mechanism of a pressure leak means in the embodiment of FIG. 1.
Figure 10:
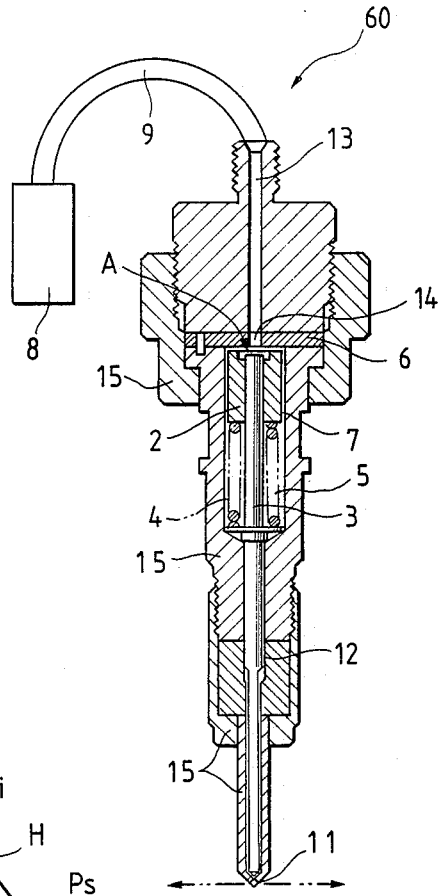
FIG. 10 PRIOR ART
FIG. 10 is a sectional view of an example of a conventional accumulator fuel injection system.
Figure 11:
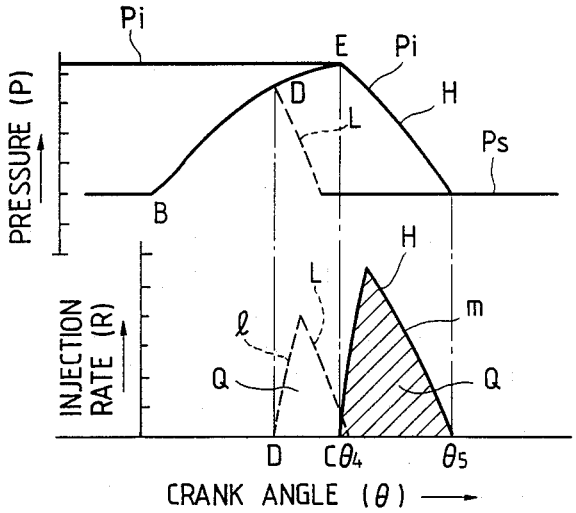
FIG. 11 PRIOR ART
FIG. 11 is a graph showing the relation between a crank angle, pressure in an accumulator and an injection rate in the accumulator fuel injection system of FIG. 10.

First, an embodiment of the accumulator fuel injection system according to the present invention will be described in detail with reference to FIGS. 1, 2, 3A, 3B and 3C. Referring to FIG. 1, an accumulator fuel injection system 10 according to the present invention is identical in construction with the accumulator fuel injection system 60 described previously with reference to FIG. 10, except that the former is provided with a means for leaking the fuel supply pressure in an accumulator 5, and a constant pressure chamber formed on the downstream side of the pressure leak means and adapted to discharge a fuel supply pressure higher than a predetermined level. Therefore, the parts of this embodiment which are the same as those of the fuel injection system 60 are designated by the same reference numerals as shown in FIG. 10, and the descriptions of the construction of such parts are omitted.

Figure 3A:
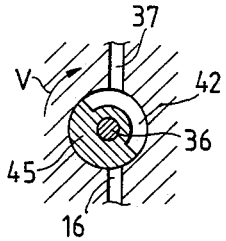
FIGS. 3A–3C illustrate the examples of the opened and closed condition of a control valve in the pressure leak means in the embodiment of FIG. 1.
Figure 3B:
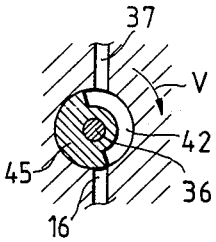
Figure 3C:
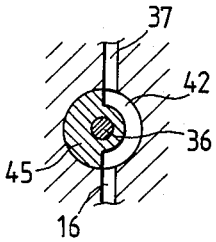

First, this pressure leak means consists of a leak passage 16 communicating with a clearance 7 on the outer side of the outer circumferential surface of a check valve 2 and formed in a fuel injection nozzle body 30, a leak passage 37 joined to the leak passage 16 via a plug 39, a control valve 34 provided between the leak passages 16, 37 and composed of a rotatable plunger 36, and a solenoid 35 for rotating the plunger 36. A check valve seat 6 is provided therein with a leak passage 17 so that the leak passage 17 communicates with the clearance 7, the leak passage 17 also communicating with the leak passage 16. Accordingly, the leak passage 16 constantly communicates with the accumulator 5. The control valve 34 has a valve body 45 which is formed integrally with one end portion of the plunger 36, and a semi-annular communication passage 42 is formed in a predetermined portion of the outer circumferential surface of the valve body 45. A swing arm 38 is fixed to the other end portion of the plunger 36, and a solenoid piston 44 is connected rotatably to the free end portion of this swing arm 38. This solenoid piston 44 can be moved forward and backward when the solenoid 35 is energized. In a normal case, i.e., when the solenoid 35 is not energized, the control valve 34 is set so that the leak passages 16, 37 are shut off from each other as shown in FIG. 3A. When the solenoid 35 is energized, the swing arm 38 is turned in the direction of an arrow V by the solenoid piston 44, so that the plunger 36 and the valve body 45 formed integrally with the plunger 36 are turned in the direction of the same arrow V. The turning of the valve body 45 causes the leak passages 16, 37 to be set in a communicating state (shown in FIG. 3C) through the communication passage 42 in the valve body 45 via a communication starting state (shown in FIG. 3B). The communication passage 42 formed in a part of the outer circumferential surface of the valve body 45 which is formed integrally with the plunger 36 can allow the leak passages 16, 37 to communicate with each other when the plunger 36 has been turned at a predetermined angle by an operation of the solenoid 35. A reference numeral 46 in FIG. 1 denotes a plunger-sealing O-ring.

A constant-pressure chamber 40 in this accumulator fuel injection system 10 will now be described. An inlet of the constant-pressure chamber 40 is connected to the leak passage 37 which is on the downstream side of the control valve 34. An outlet of the constant-pressure chamber 40 is connected to a leak passage 43 via a relief valve 41, and the leak passage 43 to a fuel tank to which the fuel is discharged. The pressure in this relief valve 41 is set to a level not higher than a pressure at which a needle valve 3 is opened, and not lower than the atmospheric pressure. Accordingly, the fuel pressure in the constant-pressure chamber 40 is always controlled owing to the functions of the relief valve 41 to a level not lower or not higher than a predetermined level. In other words, the fuel allowed to leak out from the accumulator 5 by an operation of the control valve 34 maintains the fuel supply pressure in the accumulator 5 at a predetermined level without decreasing this fuel supply pressure to an unnecessarily low level, owing to the functions of the constant-pressure chamber 40 and relief valve 41. Therefore, this accumulator fuel injection system enables an operation of increasing the fuel pressure in the accumulator 5 to be carried out smoothly without wasting time in a subsequent fuel atomizing step since a predetermined fuel supply pressure is thus maintained in the accumulator 5.

Figure 4:
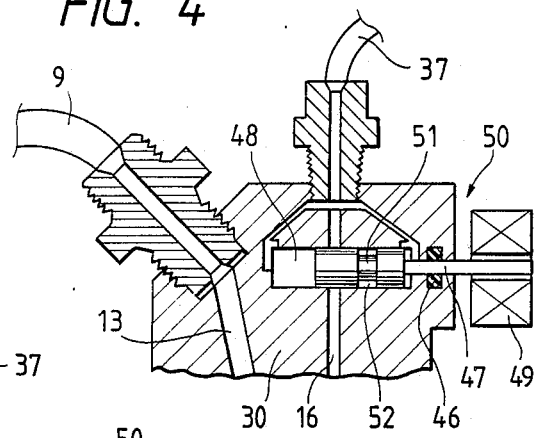
FIG. 4 is a sectional view of another example the control valve in the pressure leak means in the accumulator fuel injection system according to the present invention.
Figure 5:
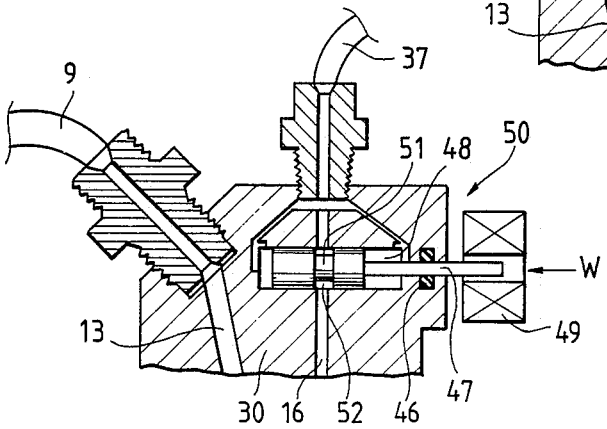
FIG. 5 is a sectional view showing an operational condition, which is different from that shown in FIG. 4, of the control valve of FIG. 4.

Another embodiment of the accumulator fuel injection system according to the present invention will now be described with reference to FIGS. 4 and 5. This embodiment is entirely identical with the above-described embodiment except that the construction of a pressure leak means in the former is slightly different from that of the latter. Therefore, the parts of the second embodiment which are identical with those of the first embodiment, or which have the same functions as those of the first embodiment, are designated by the same reference numerals, and will not twice be described. This pressure leak means consists of a control valve 50 composed of a plunger 47 provided between the leak passages 16, 37 and capable of being moved forward and backward, and a solenoid 49 adapted to move the plunger 47 forward and backward. The control valve 50 has a valve body 51 joined integrally to one end portion of the plunger 47 and provided in a cylinder 48, which is formed in the fuel injection nozzle body 30, in such a manner that the valve body 51 can be moved forward and backward, and an annular communication passage 52 is formed around the outer circumferential surface of the body 51. The other end portion of the plunger 47 is formed out of a magnetic material so that the plunger 47 can be moved forward and backward by the energization of the solenoid 49. In a normal case, i.e., when the solenoid 49 is not energized. The control valve 50 is set so that the leak passages 16, 37 are shut off from each other as shown in FIG. 4. When the solenoid 49 is energized, the plunger 47 and the valve body 51 formed integrally with the plunger 47 are moved in the direction of an arrow W to be put in the condition shown in FIG. 5. This movement of the valve body 51 causes the leak passages 16, 37 to communicate with each other via the communication passage 52. Namely, the communication passage 52 formed in a part of the outer circumferential surface of the valve body 51, which is formed integrally with the plunger 47, enables the leak passages 16, 37 to communicate with each other by the predetermined forward and backward movements made by an operation of the solenoid 49 of the plunger 47.

Figure 6:
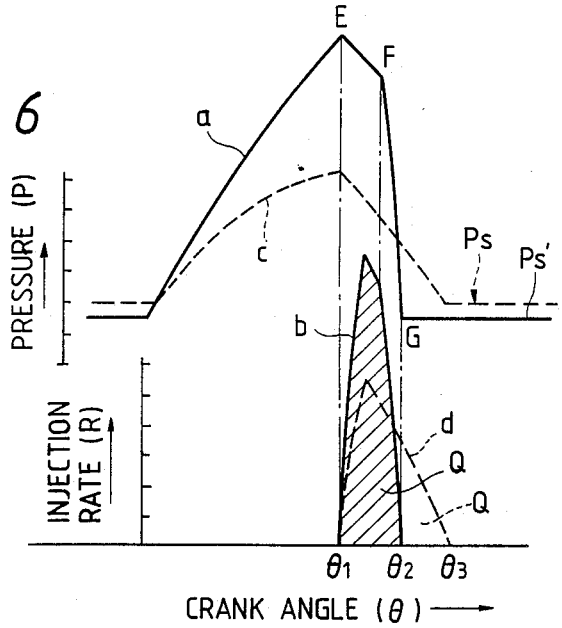
FIG. 6 is a graph showing the relation between a crank angle, pressure in an accumulator and an injection rate in the accumulator fuel injection system of FIG. 1.

This accumulator fuel injection system 10 is constructed as described above, and capable of being operated as shown in FIG. 6. The graph of FIG. 6 shows an injection rate R in this accumulator fuel injection system 10 and a pressure P in the accumulator 5 therein. A crank angle $\theta$ of the engine is plotted on the lateral axis, and an injection rate R and a pressure P in the accumulator 5 on the longitudinal axis. The solid curves a, b represent the data on the accumulator fuel injection system according to the present invention, and the broken curves c, d the data on a generally-used accumulator fuel injection system.

An injection quantity Q, which is determined by the injection rate R and the pressure P in the accumulator 5, in this embodiment is equal to that in the previously-described accumulator fuel injection system 60 but a difference between the embodiment and the injection system 60 resides in that the pressure P in the accumulator 5 in the former is reduced instantaneously to Ps' not higher than a pressure Ps for closing the needle valve 3, which is determined by the spring 4, by giving exit to the pressure in the accumulator 5. First, the period of sending the fuel under pressure from the fuel injection pump 8 terminates at a point E, and the fuel is then ejected from the injection port 11 of the fuel injection nozzle. When a predetermined period of time has then elapsed, i.e., at a point F in time, the solenoid 35 or 49 is energized to open the control valve 34 or 50 and allow the leak passages 16, 37 to communicate with each other. Consequently, the fuel in the accumulator 5 leaks instantaneously into the constant-pressure chamber 40 through the clearance 7 around the outer circumferential surface of the check valve and leak passages 17, 16, 37. Owing to instantaneous leakage of the pressure from the accumulator 5, the pressure P in the accumulator 5 decreases to Ps' not higher than the pressure Ps for closing the needle valve 3. In other words, the pressure Ps' corresponds to the pressure, which is set in advance in the relief valve 41, in the constant-pressure chamber 40. The crank angles $\theta_1$–$\theta_2$ correpond to the fuel injection period in the accumulator fuel injection system according to the present invention, and the crank angles $\theta_1$–$\theta_3$ to that in the conventional accumulator fuel injection system 60. The injection quantity Q of the accumulator fuel injection system 10 according to the present invention is represented by the area enclosed with the curve b, while the fuel injection quantity Q of the conventional accumulator fuel injection system 60 is represented by the area enclosed with the curve d. When the pressure in the accumulator 5 leaks as mentioned above, the needle valve 3 is pressed down along with the check valve 2 against the reaction force of the spring 4, and the injection port 11 is closed with the needle valve 3, so that the fuel injection terminates at a point G. Therefore, the injection period of the accumulator fuel injection system according to the present invention is reduced greatly as compared with that of the conventional accumulator fuel injection system, and the injection pressure in the former can be increased to a great extent. Moreover, the present invention enables a predetermined fuel injection quantity to be secured without being influenced by the pressure in the accumulator 5.

Figure 8:
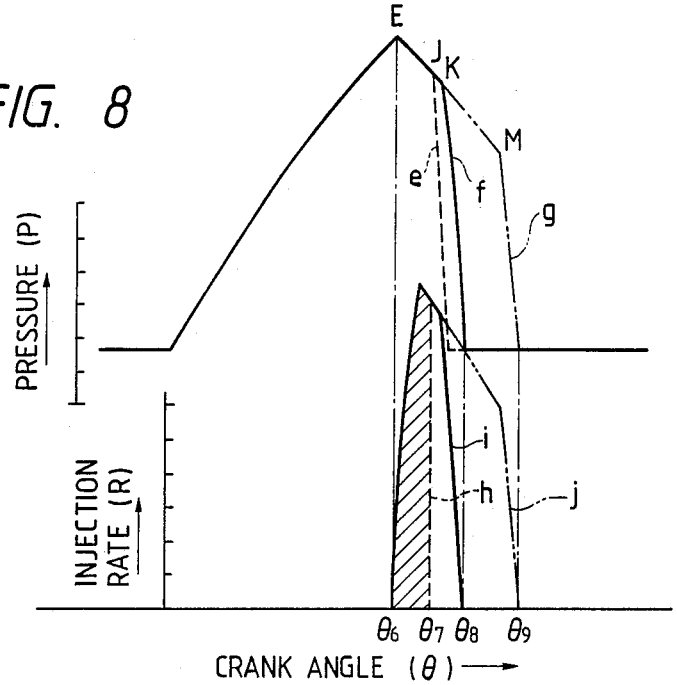
FIG. 8 is a graph showing the relation between a crank angle, pressure in an accumulator and an injection rate in still another embodiment of the accumulator fuel injection system according to the present invention.

The injection condition shown in FIG. 8 can also be obtained as another operation of the accumulator fuel injection system. This fuel injection system is characterized in that it is constructed by a combination of a generally-used fuel injection pump and a solenoid-carrying accumulator fuel injection nozzle, from which injection nozzle a maximum number of revolutions controlling governing mechanism, a fuel flow rate control system for a control sleeve and a control rack, and a control for a timing angle of advance, all of which are provided necessarily in a generally-used fuel injection pump, are removed. Referring to FIG. 8, a broken curve e, a solid curve f and a chain curve a represent a crank angle $\theta$, a pressure P in the accumulator and an injection rate R at the low load time, intermediate load time and high load time, respectively. First, the sending of a fuel under pressure from the fuel injection pump to the accumulator terminates at a point E, i.e., at a crank angle $\theta_6$. At the low load time, the solenoid is energized at a point J to operate the pressure leak means and leak the pressure in the accumulator, whereby the injection of the fuel from the injection port 11 into the combustion chamber in the engine is completed at a crank angle $\theta_7$. At the intermediate load time, the solenoid is energized at a point K to operate the pressure leak means and leak the pressure in the accumulator 5, whereby the injection of the fuel from the injection port 11 into the combustion chamber in the engine is completed at a crank angle $\theta_8$. At the high load time, the solenoid is energized at a point M to operate the pressure leak means and leak the pressure in the accumulator 5, whereby the injection of the fuel from the injection port 11 into the combustion chamber in the engine is completed at a crank angle $\theta_9$. The accumulator fuel injection system in this embodiment is capable of controlling the fuel injection in the above-described manner, so that this fuel injection system can render it unnecessary to provide the same with a maximum number of revolutions controlling governing mechanism and a fuel flow rate control system for a control sleeve and a control rack.

Figure 9:
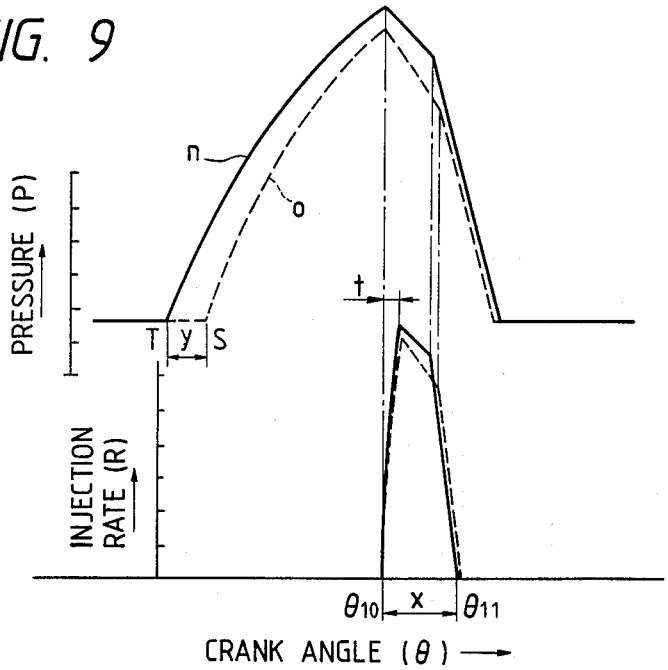
FIG. 9 is a graph showing a timing angle of advance of a fuel injection pump.

A case where a timing angle of advance is put in operation by this fuel injection pump will now be described with reference to FIG. 9. Such an operation can be carried out by controlling a point in time at which the pressure in the accumulator starts increasing. To carry out this operation, a point T on a solid curve n in the accumulator pressure increase diagram is shifted to a point S on a broken curve o to delay a pressure increasing operation. The shifting of the point T to the point S by a distance y can be attained by opening the control valve 34, 50, which is controlled by the solenoid in the accumulator fuel injection system according to the present invention, to leak the fuel. Due to the delay in the closing of this control valve 34, 50, the starting of the pressure increasing operation delays (by a length y), and also the starting of the fuel injection can be delayed (by a length y). In other words, when the engine speed is low, the increasing of the pressure is started at the point S, and, as the engine speed increases, the crank angle is shifted little by little from the point S to the point T to advance the crank angle. Although there is a little loss in the injection characteristics, i.e. an increase of a length x from a crank angle $\theta_{10}$ to a crank angle $\theta_{11}$, it is not so large, and it does not have any bad influence. Similarly, the injection starting time can be controlled variably in accordance with the engine load.

Figure 7:
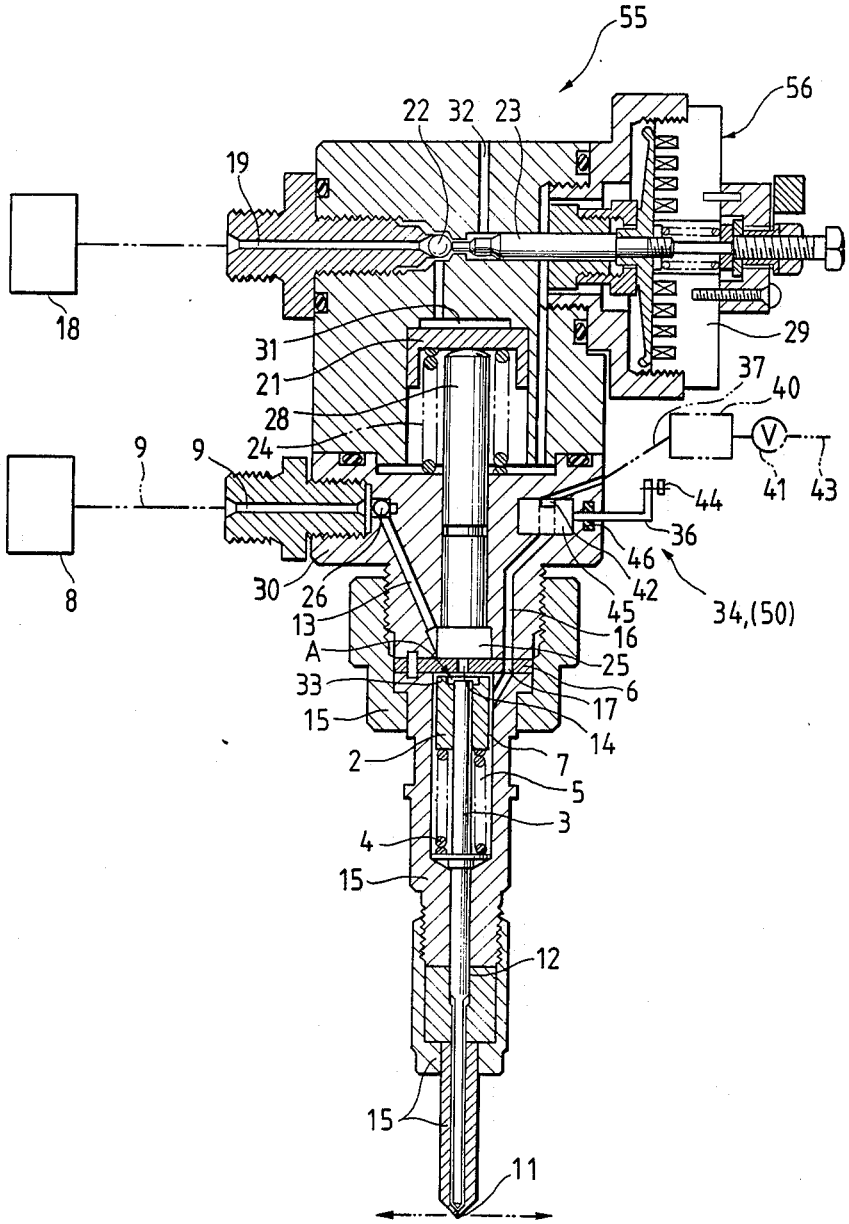
FIG. 7 is a sectional view of a pressure increasing type accumulator fuel injection system constituting another embodiment of the present invention.

The accumulator fuel injection system according to the present invention can also be applied to a pressure increasing type accumulator fuel injection system provided with a pressure chamber 25 to which a pressure is supplied by an operation of a solenoid valve, and shown in FIG. 7. Referring to FIG. 7, the construction of the pressure increasing type accumulator fuel injection system 55 is identical with the above-described accumulator fuel injection system 10 except that the former system 55 is provided additionally with a pressure increasing mechanism 56, and the parts of this fuel injection system which are identical with those of the fuel injection system 10 are disignated by the same reference numerals, the descriptions of such parts being omitted. The pressure increasing mechanism 56 constituting a pressure increasing means is provided with a fuel injection pump 18 which is operated independently of a fuel injection pump 8 for use in supplying a fuel to be injected. The fuel injection pumps 8, 18 are constructed so that a high pressure of about 100–200 Kg/cm$^2$ is always applied thereto. The fuel injection pump 18 is adapted to operate a pressure increasing piston 21 provided in a fuel injection nozzle body 30. An operation of the fuel injection pump 18 causes the pressure increasing piston 21 to be moved down. During this time, a pressure is applied to the interior of a pressure chamber 25 formed in a fuel injection nozzle body 30 in accordance with a ratio of the outer sizes of the pressure increasing piston, i.e. the surface area thereof receiving a liquid hydraulic pressure from the fuel injection pump 18 to the outer sizes of a plunger 28, i.e. the surface area thereof facing the pressure chamber 25. For example, when the surface area ratio and the pressure of the fuel injection pump 18 are 10 and 100–200 Kg/cm$^2$, respectively, the pressure in the pressure chamber becomes 1000–2000 Kg/cm$^2$. Accordingly, the pressure in the accumulator 5 increases correspondingly. While a pressure is applied to the pressure chamber 25 to increase the pressure therein, a check ball 26 provided between an injection pipe 9 and a passage 13 is moved in the direction (leftward in the drawing) in which the injection pipe 9 is closed. Owing to these operations, the pressure chamber 25 and accumulator 5 are filled with the pressure-increased fuel. During this time, a plunger 23 is moved to left in the drawing by an operation of a solenoid 29 to move a check ball 22 to left in the drawing and close an injection pipe 19, and allow a pressure chamber 31 to communicate with a passage 32, which is open to the atmosphere, to cause the interior the pressure of which works on a pressure-increasing piston 21 of the pressure chamber 31 to communicate with the atmosphere. As a result, the pressure-increasing piston 21 is moved up owing to the reaction force of a spring 24, and a plunger 28 is also moved up accordingly, the pressure in the pressure chamber 25 decreasing, the check ball 26 being then released to cause the injection pipe 9 and a passage 13 to communicate with each other. Consequently, the pressure chamber 25 communicates with the fuel injection pump 8, so that the fuel is supplied to the pressure chamber 25 by the fuel injection pump 8. Therefore, the pressure in the pressure chamber 25 becomes, for example, 100 Kg/cm$^2$ owing to the operation of the fuel injection pump 8, and a check valve 2 is moved up due to the reaction force of a spring 4 and the released pressure (for example, 100 Kg/cm$^2$ in this case) from the pressure chamber 25 and pressed against a check valve seat 6. When a projecting portion 33 of the check valve 2 engages the check valve seat 6, the pressure chamber 25, i.e. a through bore 14 in the check valve seat 6 and a clearance 7 around the outer circumferential surface of the check valve 2 are shut off from each other. As a result, the accumulator 5 becomes a sealed high-pressure chamber. At the same time, a needle valve 3 is moved up due to the reaction force of the spring 4 and the released pressure from the pressure chamber 25, and the fuel stored in the accumulator 5 is injected from the injection port 11 into the combustion chamber in the engine. The injection of the fuel thus carried out causes the pressure in the accumulator 5 to decrease, and puts an end to the injection operation with the reaction force of the spring 4 and the pressure in the accumulator 5 in a balanced state. The above-described operations are repeated to successively carry out the injection of the fuel into the combustion chamber in the engine. This embodiment described above consists of an example in which the control valve 34, 50 composed of a plunger responding to the solenoid 35 is employed as a pressure leak means for the accumulator 5. The embodiment can, of course, be constructed so that this control valve is used as the pressure increasing mechanism 56.

Since the pressure leak means provided with a constant-pressure chamber 40 for leaking the pressure in the accumulator 5 in the above-described accumulator 5 is identical with that employed in the accumulator fuel injection system 10 described with reference to FIG. 1, the parts of the fuel injection system 55 which are the same as those of the fuel injection system 10 are designated by the same reference numerals, and the descriptions thereof will be omitted. This pressure-increasing type accumulator fuel injection system 55 is adpated to pressurize a comparatively-low-pressure fuel by the pressure increasing piston 21, send the fuel into the accumulator 5 and inject the fuel from the injection port 11 into the combustion chamber in the engine, and it has a potential ability to generate a very high injection pressure. Since there is a limit to the reduction of the capacity of the accumulator 5 in view of the construction of this system, it is impossible to carry out a high-pressure injection operation with a small injection quantity. However, owing to the pressure leak means consisting of the solenoid valve 35, the termination of the fuel injection can be controlled, and a fuel injection pressure of, for example, not lower than 2000–3000 $Kg/cm^2$ can be obtained.

What is claimed is:

1. An accumulator fuel injection system comprising a fuel injection pump for use in supplying a fuel, a fuel injection nozzle body provided with a fuel passage for receiving the fuel supplied from said fuel injection pump, an accumulator formed in said fuel injection nozzle body and used to temporarily accumulate a fuel supply pressure from said fuel injection pump, a check valve provided in said fuel injection nozzle body and adapted to be opened in response to a level, which is not lower than a predetermined level, of a fuel supply pressure in said fuel passage so as to supply the fuel from said fuel passage to said accumulator, injection ports formed in said fuel injection nozzle body so as to inject the fuel therefrom, a needle valve provided in said fuel injection nozzle body so as to open and close said injection ports, a first leak passage formed in said fuel injection nozzle body and constantly communicating with said accumulator, a control valve provided in said first leak passage so as to switch between an opened and closed states of said first leak passage and adapted to open said first leak passage so as to reduce the pressure in said accumulator to a level not higher than a pressure for closing said needle valve, and a means for opening and closing said control valve by the energization of a solenoid.

2. An accumulator fuel injection system according to claim 1, wherein said check valve has a valve body fitted around said needle valve, and a spring urging said valve body in a valve body closing direction, said accumulator communicating with said first leak passage through a clearance between said fuel injection nozzle body and the outer circumferential surface of said valve body.

3. An accumulator fuel injection system comprising a fuel injection pump for use in supplying a fuel, a fuel injection nozzle body provided with a fuel passage for receiving the fuel supplied from said fuel injection pump, a accumulator formed in said fuel injection nozzle body and used to temporarily accumulate a fuel supply pressure from said fuel injection pump, a check valve provided in said fuel injection nozzle body and adapted to be opened in response to a level, which is not lower than a predetermined level, of a fuel supply pressure in said fuel passage so as to supply the fuel from said fuel passage to said accumulator, injection ports formed in said fuel injection nozzle body so as to inject the fuel therefrom, a needle valve provided in said fuel injection nozzle body so as to open and close said injection ports, a first leak passage formed in said fuel injection nozzle body and constantly communicating with said accumulator, a control valve provided in said first leak passage so as to switch between opened and closed states of said first leak passage and adapted to open said first leak passage so as to reduce the pressure in said accumulator to a level not higher than a pressure for closing said needle valve, a plunger provided in said control valve so as to open and close the same valve by an operation of a solenoid, a second leak passage positioned on the downstream side of said control valve and communicating with said first leak passage, and a pressure chamber provided in said second leak passage and having a means for maintaining the pressure in said accumulator at a level not lower than a predetermined level.

4. An accumulator fuel injection system according to claim 3, wherein said plunger and said control valve are rotatable in said fuel injection nozzle body, the opening and closing of said leak passages being controlled by said control valve in accordance with an angle of rotation of said plunger driven by the energization of said solenoid.

5. An accumulator fuel injection system according to claim 3, wherein said plunger and said control valve can be moved forward and backward in said fuel injection nozzle body, the opening and closing of said leak passages being controlled by said control valve in accordance with a moving distance of said plunger moved by the energization of the solenoid.

6. An accumulator fuel injection system according to claim 3, wherein said means for maintaining the pressure in said accumulator at a level not lower than a predetermined level when said control valve is opened consists of a relief valve provided in said second leak passage.

7. An accumulator fuel injection system comprising a fuel injection pump for use in supplying a fuel, a fuel injection nozzle body provided with a fuel passage for receiving the fuel supplied from said fuel injection pump, an accumulator formed in said fuel injection nozzle body and used to temporarily accumulate a fuel supply pressure from said fuel injection pump, a pressure chamber formed in said fuel injection nozzle body and communicating with said fuel passage receiving the fuel supplied from said fuel injection pump, a check valve provided in said fuel injection nozzle body and adapted to be opened in response to a level, which is not lower than a predetermined level, of a fuel supply pressure in said pressure chamber so as to supply the fuel from said pressure chamber to said accumulator, a pressure-increasing piston for use in pressurizing the fuel in said pressure chamber, a pressure-increasing means for pressing said pressure-increasing piston so as to pressurizing the fuel in said pressure chamber, injection ports formed in said fuel injection nozzle body so as to inject the fuel therefrom, a needle valve provided in said fuel injection nozzle body so as to open and close said injection ports, a first leak passage formed in said fuel injection nozzle body and constantly communicating with said accumulator, a control valve provided in said first leak passage so as to switch between opened and closed states of said first leak passage and adapted to open said first leak passage so as to reduce the pressure in said accumulator to a level not higher than a pressure for closing said needle valve, a plunger provided in said control valve so as to open and close the same valve by the energization of a solenoid, a second leak passage positioned on the downstream side of said control valve and communicating with said first leak passage, and a pressure chamber provided in said second leak passage and having a means for maintaining the pressure in said accumulator at a level not lower than a predetermined level.

8. An accumulator fuel injection system according to claim 7, wherein said plunger and said control valve are rotatable in said fuel injection nozzle body, the opening and closing of said leak passages being controlled by said control valve in accordance with an angle of rotation of said plunger driven by the energization of said solenoid.

9. An accumulator fuel injection system according to claim 7, wherein said plunger and said control valve can be moved forward and backward in said fuel injection nozzle body, the opening and closing of said leak passages being controlled by said control valve in accordance with a moving distance of said plunger moved by the energization of the solenoid.

10. An accumulator fuel injection system according to claim 7, wherein said means for maintaining the pressure in said pressure chamber at a level not lower than a predetermined level when said control valve is opened consists of a relief valve provided in said second leak passage.

* * * * *